US005732725A

United States Patent [19]

Ko

[11] Patent Number: 5,732,725

[45] Date of Patent: Mar. 31, 1998

[54] SAFETY RUNNER USED IN UMBRELLAS

[76] Inventor: Chin-Sung Ko, 27-1, Lane 188, Chin Mar Road, Sec. 3, Chanhua City, Taiwan

[21] Appl. No.: 783,662

[22] Filed: Jan. 15, 1997

[51] Int. Cl.[6] ..... A45B 25/06

[52] U.S. Cl. ..... 135/28; 135/41

[58] Field of Search ..... 135/28, 38, 39, 135/40, 41

[56] References Cited

U.S. PATENT DOCUMENTS

| | | | |
|---|---|---|---|
| 166,980 | 8/1875 | Francis | 135/41 |
| 303,353 | 8/1884 | Wilson | 135/41 |
| 526,155 | 9/1894 | Kimball | 135/41 |
| 558,530 | 4/1896 | Simmons | 135/41 |
| 566,610 | 8/1896 | Newman et al. | 135/41 |
| 571,911 | 11/1896 | Stokes | 135/41 |
| 631,442 | 8/1899 | Rose . | |
| 3,156,249 | 11/1964 | Biderman | 135/39 X |
| 3,856,032 | 12/1974 | Schafer . | |
| 5,588,455 | 12/1996 | Kuo | 135/28 |
| 5,615,698 | 4/1997 | Ko | 135/28 |

FOREIGN PATENT DOCUMENTS

| | | |
|---|---|---|
| 1375577 | 9/1964 | France . |

*Primary Examiner*—Lanna Mai

*Attorney, Agent, or Firm*—Morton J. Rosenberg; David I. Klein; Jun Y. Lee

[57] ABSTRACT

The invention relates to a safety runner used in umbrellas. The runner is provided with an elongated gap on its side surface and a resilient tab located outside the gap and extending downwardly from the runner base. The resilient tab has a raised portion formed on its internal surface. Users can depress the resilient tab to inwardly move a hook of the umbrella and so the runner can move downwardly with ease. The runner is an integrally molded part that has the advantages of simplified construction and safety in use.

1 Claim, 3 Drawing Sheets

SAFETY RUNNER USED IN UMBRELLAS

BACKGROUND OF THE INVENTION

Generally an umbrella uses the hook of a locking device in the umbrella shaft to detain the runner so that the umbrella can stay in an open state. To close the umbrella the user must depress the hook to release the runner. With such a design the finger pushing the hook is often hurt by a quickly moving runner. Therefore, some improvements have been suggested to eliminate such defects. As an illustrative example, the U.S. Pat. No. 566,610 employs an additive component affixed to the lower straight portion of a runner. That component has an extending portion located near the hook so that when users push down the hook their fingers would not be injured by runners. However, the component is an individual part. It might be displaced or drop out of position. It also needs to pay attention to the alignment between the component and the hook when in use. Hence, it is still inconvenient in use. Besides, the separate part is easy to lose and increases complexity in assembling. The U.S. Pat. No. 1,612,290 uses a curved plate attached to the runner to cover the hook. Such a part is independent and still easy-to-separate. It also has the disadvantage of unintentionally depressing the hook.

Accordingly the primary object of the invention is to provide an improved safety runner for use in umbrellas that has enhanced performances and positive effectiveness and is integrally molded to give users convenience in use. Now the invention will be detailed in the following description with reference to the accompanying drawings.

BRIEF DESCRIPTION OF ACCOMPANYING DRAWINGS

Figure 4:
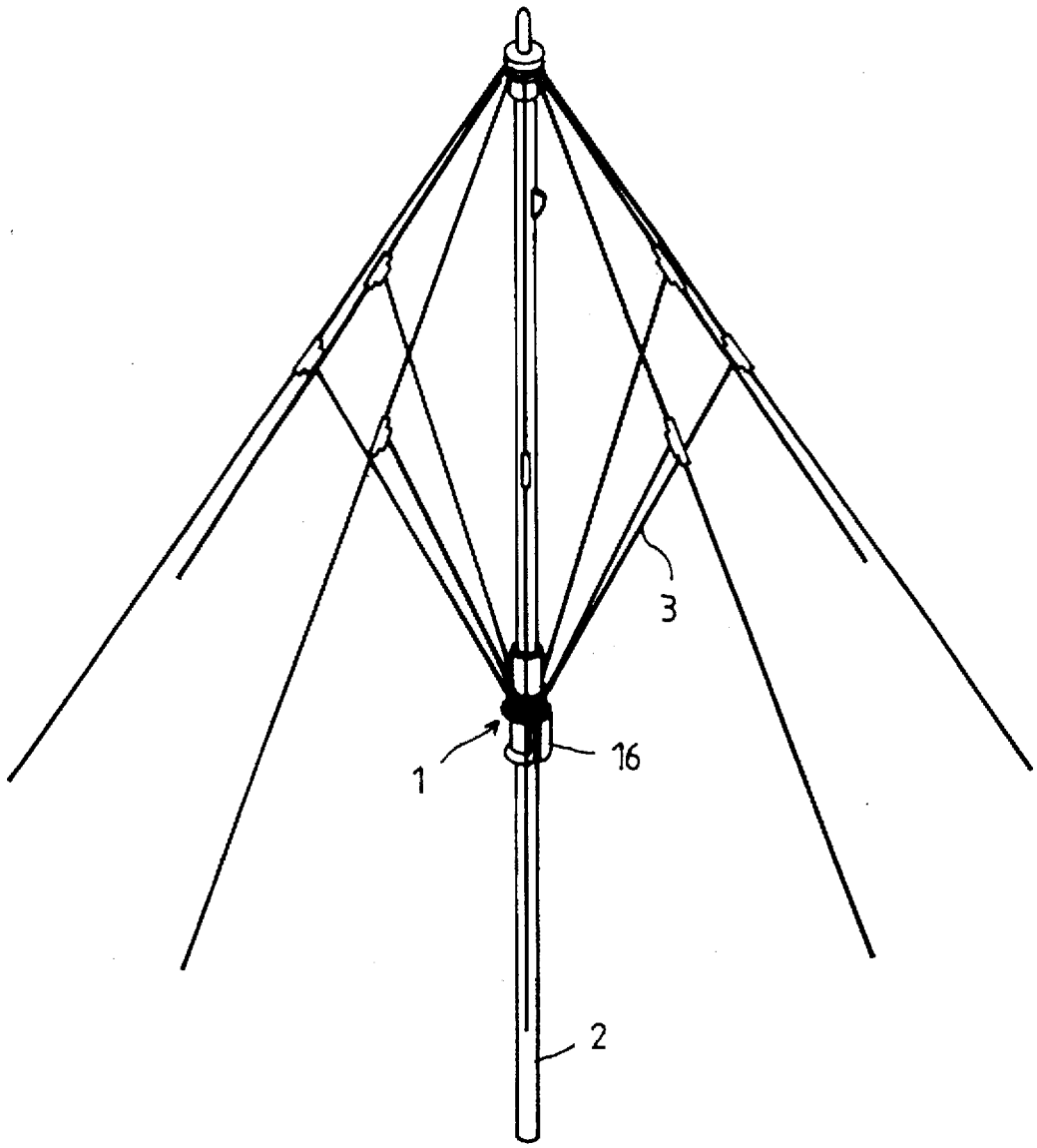

FIG. 4 perspectively shows the practice of the invention.

DETAILED DESCRIPTION OF PREFERRED EMBODIMENTS

Figure 1:
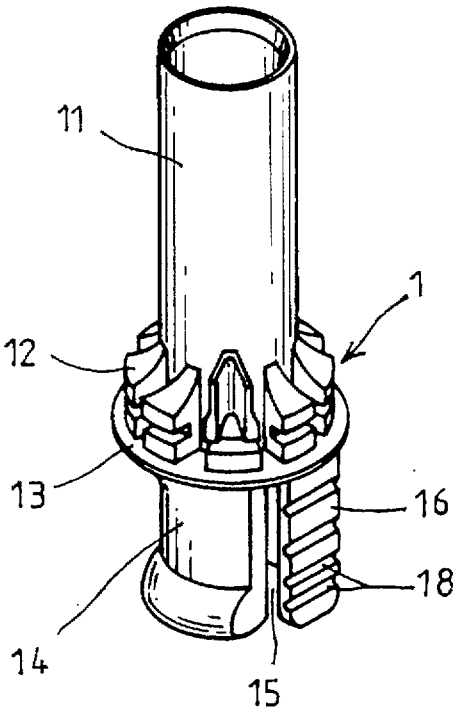
FIG. 1 is a perspective view of a safety runner according to the invention.
Figure 2:
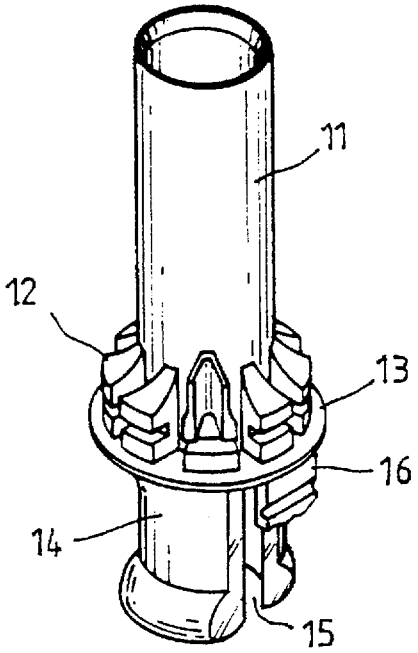
FIG. 2 is a partially sectional view of the runner of FIG. 1.

Referring to FIGS. 1 and 2, the improvements according to the invention are made on an umbrella runner, which includes a tubular portion (11), a nest portion (12), a base (13), and a lower portion (14). With the aid of the tubular portion (11), which mounts on an umbrella shaft (2), the runner (1) can smoothly slide on the umbrella shaft (2). The nest portion (12) can enhance the strength of the runner (1) and have a sturdy combination with umbrella stretchers (3) due to its integration with the base (13). The invention is characterized in that the lower portion (14) of the runner has a flat side surface with an elongated gap (15) formed thereon. The gap (15) is sized to allow a hook (21) in the umbrella shaft (2) to extend through. A resilient tab (16) in parallel with the gap (15) extends downwardly from the underside of the base (13). The resilient tab (16) locates outside the gap (15) and has a raised portion (17) on its internal surface and a plurality of teeth (18) on its external surface to give users a better tactile feeling.

Figure 3:
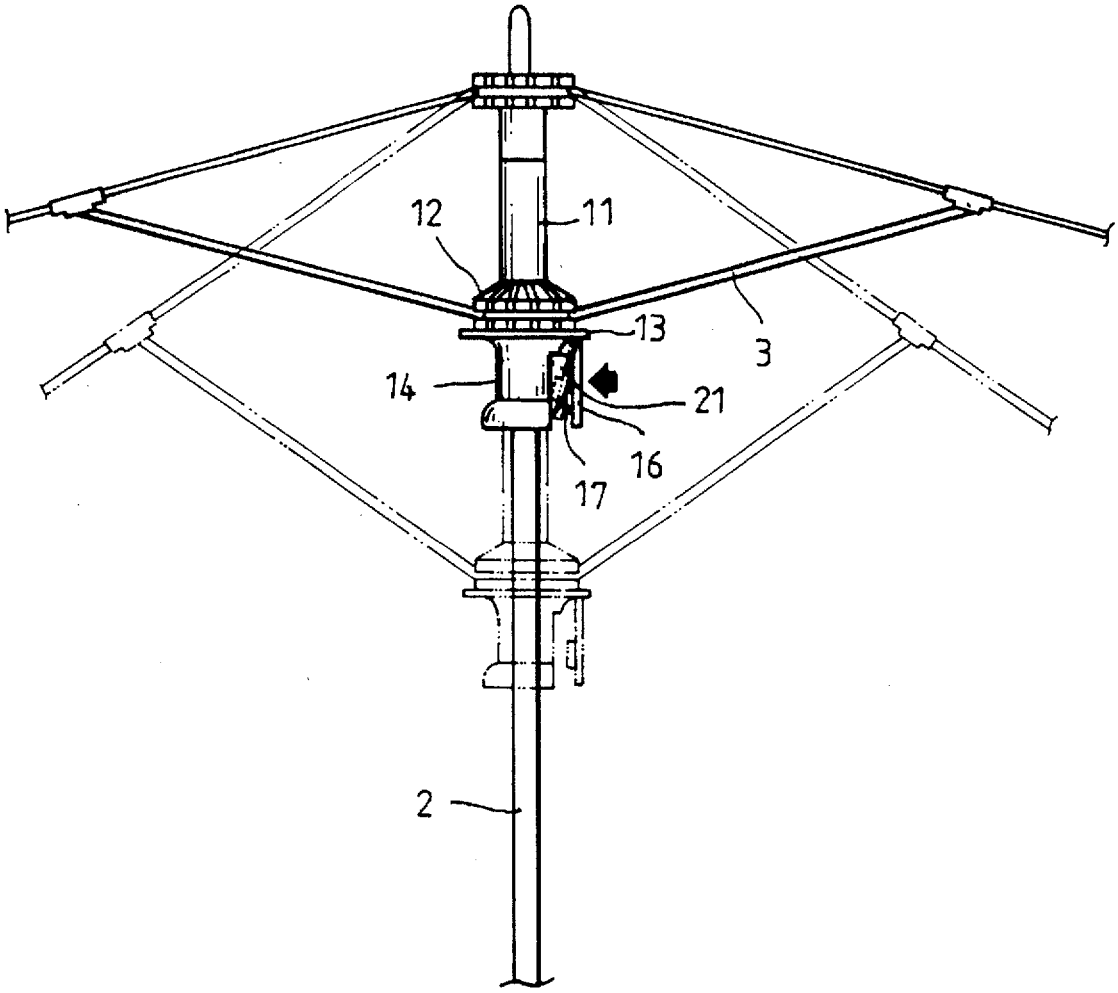
FIG. 3 is a plan view showing the practice of the inventive runner.

FIGS. 3 and 4 illustrate the practice of the invention. The runner (1) according to the invention is an integrally formed part. It will never bring along any troubles in assemblage or alignment. Users can close the umbrella with ease by depressing the resilient tab (16) to make the hook (21) move inwardly. Hence it can reach a satisfied safety effect.

From the above description, the invention indeed eliminates the drawbacks of conventional umbrella runners and provides umbrellas a more safe and effective runner structure that makes the operations of the umbrella more smooth and convenient. Thus the invention has value in the industry.

What is claimed is:

1. A safety runner used in umbrellas comprising a tubular portion in the upper segment thereof that can slide on an umbrella shaft, a nest portion and a base in the middle segment, and a lower straight portion, and characterized in that the lower straight portion is provided with a flat side surface with an elongated gap that is sized to allow a hook in an umbrella shaft to extend through and in that a resilient tab located outside the gap extends downwardly from the underside of the base and has a raised portion on its internal surface and in that the runner is an integrally molded part.

* * * * *